US005325651A

United States Patent [19]

Meyer et al.

[11] Patent Number: 5,325,651

[45] Date of Patent: Jul. 5, 1994

[54] WALL FRAME STRUCTURE

[75] Inventors: Dolph A. Meyer, Carlingford; Wijatmodjo Sardjono, Ryde, both of Australia

[73] Assignee: Uniframes Holdings Pty. Limited, Smithfield, Australia

[21] Appl. No.: 760,100

[22] Filed: Sep. 16, 1991

Related U.S. Application Data

[63] Continuation-in-part of Ser. No. 521,137, May 8, 1990, Pat. No. 5,157,883, and Ser. No. 455,428, Dec. 11, 1989, abandoned.

[30] Foreign Application Priority Data

Jun. 24, 1988 [AU] Australia ..... PI2713
May 8, 1989 [AU] Australia ..... PJ4059
Feb. 4, 1991 [AU] Australia ..... PK4446

[51] Int. Cl.[5] ..... E04B 2/00

[52] U.S. Cl. ..... 52/715; 52/243; 52/696; 52/712

[58] Field of Search ..... 52/241, 242, 243, 357, 52/358, 359, 353, 290, 264, 265, 712, 713, 715, 696

[56] References Cited

U.S. PATENT DOCUMENTS 2,218,426 10/1940 Hurlbert, Jr. ..... 52/290
2,267,477 12/1941 Siebenlist ..... 52/290
2,268,485 12/1941 Hurlbert, Jr. ..... 52/290
2,273,276 2/1942 Grotta ..... 52/243
2,329,542 9/1943 Grotta ..... 52/242
2,966,708 1/1961 Freeman, Jr. ..... 52/290
3,332,188 7/1967 Schaefer ..... 52/241
3,536,345 10/1970 Leifer ..... 52/241 X
3,680,271 8/1972 Satchell ..... 52/241 X
4,805,364 2/1989 Smolik ..... 52/241
4,809,476 3/1989 Satchell ..... 52/241
4,854,096 8/1989 Smolik ..... 52/241
5,157,883 10/1992 Meyer ..... 52/357

FOREIGN PATENT DOCUMENTS 421805 1/1971 Australia .
51891 1/1986 Australia .

*Primary Examiner*—Carl D. Friedman
*Assistant Examiner*—Robert Canfield
*Attorney, Agent, or Firm*—Ladas & Parry

[57] ABSTRACT

A wall frame for building. The wall frame includes a generally horizontally extending plate which is engaged by a stud. Relative movement between the plate and stud are inhibited by the use of clips or brackets and deformations formed in the plate. In one embodiment, the plate is provided with eyelets which project through the stud, with the eyelets being engaged by a clip. In another embodiment, a bracket surrounds the stud and engages the plate side walls to secure the stud in position.

5 Claims, 7 Drawing Sheets

WALL FRAME STRUCTURE

This is a continuation-in-part of copending application Ser. No. 07/521,137 filed on May 8, 1990 now U.S. Pat. No. 5,157,883, on Oct. 27, 1992 and Ser. No. 07/455,428 filed on Dec. 11, 1989 now abandoned.

This invention relates to metal wall frame structures, and more particularly to those applicable to domestic dwellings, sheds, halls and other public or commercial buildings.

BACKGROUND ART

For economy and ease of erection metal frames have been utilised in the construction of walls for buildings and incorporate principally a pair of spaced channelled wall plates and a plurality of channelled bridging studs interlocking with the plates. An example of such a construction is the subject matter of Australian Patent Application No. 51891/86 and Australian Patent No. 421805. In both instances the studs are generally "C-shaped", in cross-section, with small return flanges and have slots at opposite ends of each stud for locking with respective ones of the wall plates. Each of the wall plates is generally "U-shaped" with inwardly projecting lugs at the open ends of the arms. In the case of Patent 421805 lead-in chamfers are provided at the ends of the studs over which the lugs ride for engagement within the slots in the studs, in erection of a frame. In the case of Application 51891/86 erection is achieved by seating a stud within the channel of a plate and twisting the stud about its axis for engagement with securing lugs. In view of manufacturing tolerances in the construction of both plates and studs, the rigidity of an erected wall frame sometimes suffers. Additionally it has been found that this form of connection lacks sufficient strength to withstand a separation force imposed on the frame under cyclonic conditions, without additional bracing.

U.S. Pat. No. 3,680,271 describes a wall frame structure having a bottom wall plate which engages a wall stud. Both the wall plate and stud are formed of rolled steel. The wall plate has lugs which snap engage within recesses formed in the stud in order to retain the stud in position. However this particular arrangement has the disadvantage that the stud can be removed from the wall plate under stress, that is the longitudinally extending sides of the stud can become disconnected from the longitudinally extending sides of the wall plate.

U.S. Pat. No. 8,854,439 discloses a building frame including vertically extending stud members joined by strips acting as noggings. There is no consideration given to anchoring the vertical studs with a wall plate. Australian Patent 579216 describes a metal stud which engages with a bottom wall plate. The stud is provided with apertures through which lugs protrude to anchor the stud in position. However, the side flanges of the stud can become easily deflected from engagement with the longitudinally extending sides of the wall plate, when stressed.

The above discussed prior art all suffer from the disadvantage that no means is provided to ensure that the sides of the stud do not become deflected from the longitudinally extending sides of the wall plate when stressed.

DISCLOSURE OF THE INVENTION

It is the principal object of this invention to provide a metal wall frame structure which substantially ameliorates the above disadvantages.

There is disclosed herein a wall frame structure including:

a generally horizontally extending metal plate of generally "U-shaped" transverse cross-section so as to have longitudinally extending substantially parallel transversely spaced side walls, said side walls being joined by a longitudinally extending base, each side wall being deformed to have a plurality of deformations which project inwardly toward the other side wall, and which deformations are arranged in pairs, with each pair including a deformation from each side wall;

a substantially vertically extending metal stud of substantially "C-shaped" transverse cross-section so as to have longitudinally extending transversely spaced parallel side walls joined by a longitudinally extending base, said stud having adjacent one end an aperture in each stud side wall and engaged with said plate by being positioned between the plate side walls and by having the plate side walls abutting the stud side walls so as to be substantially superposed with respect thereto, each stud side wall having an aperture aligned with a respective deformation of a pair of deformations of said plate so that the associated pair of deformations extends through the apertures; and clip means engaging the deformations associated with said stud and abutting the stud side walls to thereby inhibit separation of each stud side wall with its associated superposed plate side wall, under loading.

There is further disclosed herein a wall frame structure including:

a generally horizontally extending metal plate of generally "U-shaped" transverse cross-section so as to have longitudinally extending substantially parallel transversely spaced side walls, said side walls being joined by a longitudinally extending base, each side wall being deformed to have a plurality of deformations which project towards the other side wall, and which deformations are arranged in pairs, with each pair including a deformation from each side wall;

a substantially vertical metal stud of substantially "C-shaped" transverse cross-section so as to have longitudinally extending transversely spaced parallel side walls, and a longitudinally extending base joining the stud side walls, said stud having adjacent one end an aperture in each stud side wall and engaged with said plate by being positioned between the plate side walls and having the plate side walls abutting the stud side walls so as to be substantially superposed with respect thereto, said apertures being aligned with a pair of said deformations so that the associated deformations extend through the apertures; and a clip bracket having a base extending longitudinally between said plate side walls and having an opening through which said stud passes so that the bracket substantially surrounds said stud, a flange at each longitudinal end of the bracket base engaging the plate side walls so that each plate side wall is sandwiched between its associated bracket flange and stud side wall, to inhibit relative movement between the plate side walls and the stud side walls.

BRIEF DESCRIPTION OF THE DRAWINGS

The invention will be described in more detail with reference to the accompanying drawings, in which.

BEST MODE OF CARRYING OUT THE INVENTION

Figure 1:
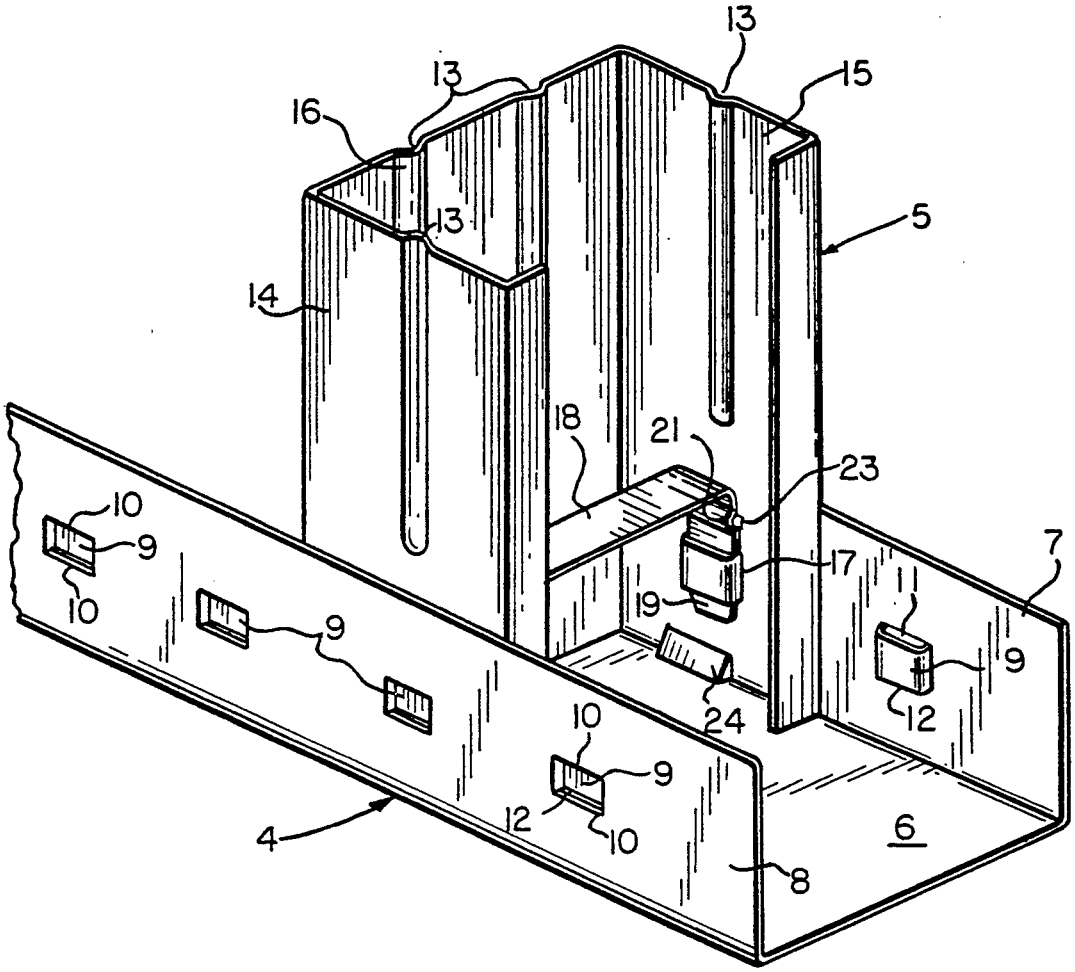
FIG. 1 shows in perspective the assembly of a stud to a plate for a wall frame structure of this invention.
Figure 2:
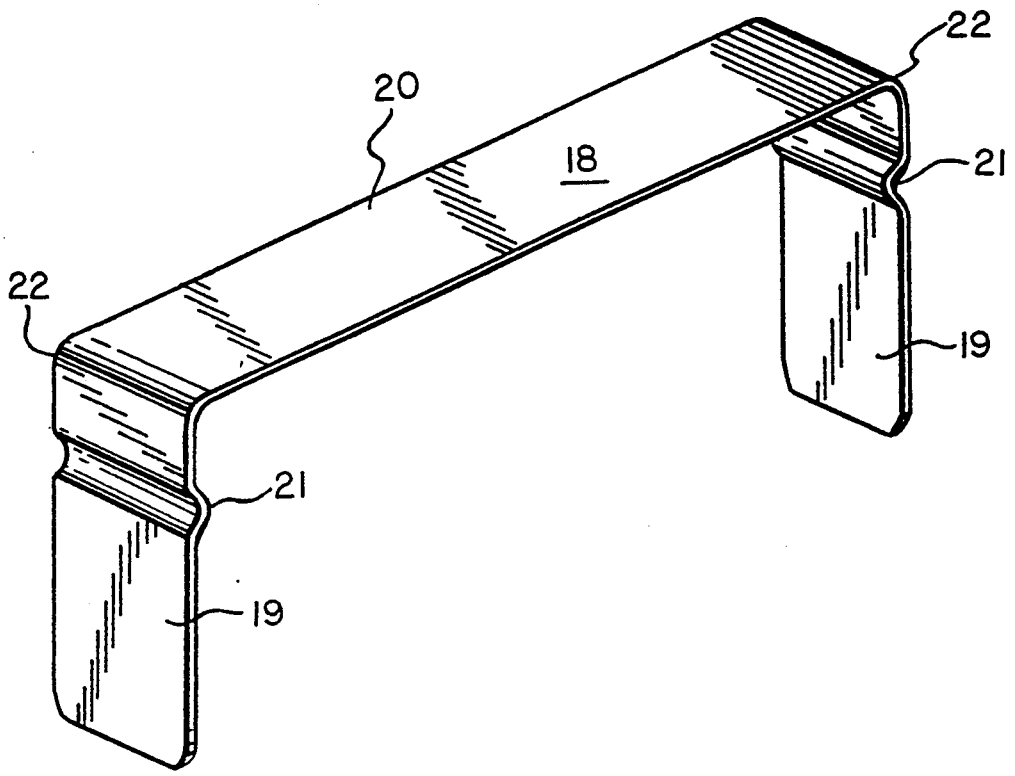
FIG. 2 depicts one embodiment of a locking clip used in the structure.
Figure 3:
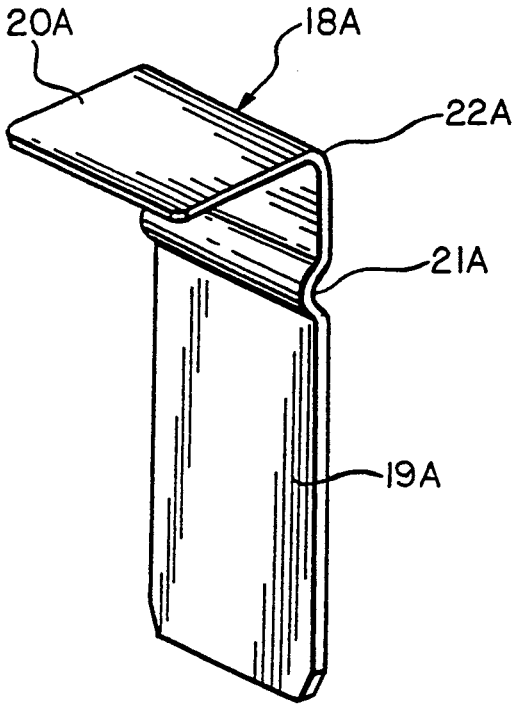
FIG. 3 depicts a second embodiment of a locking clip.
Figure 4:
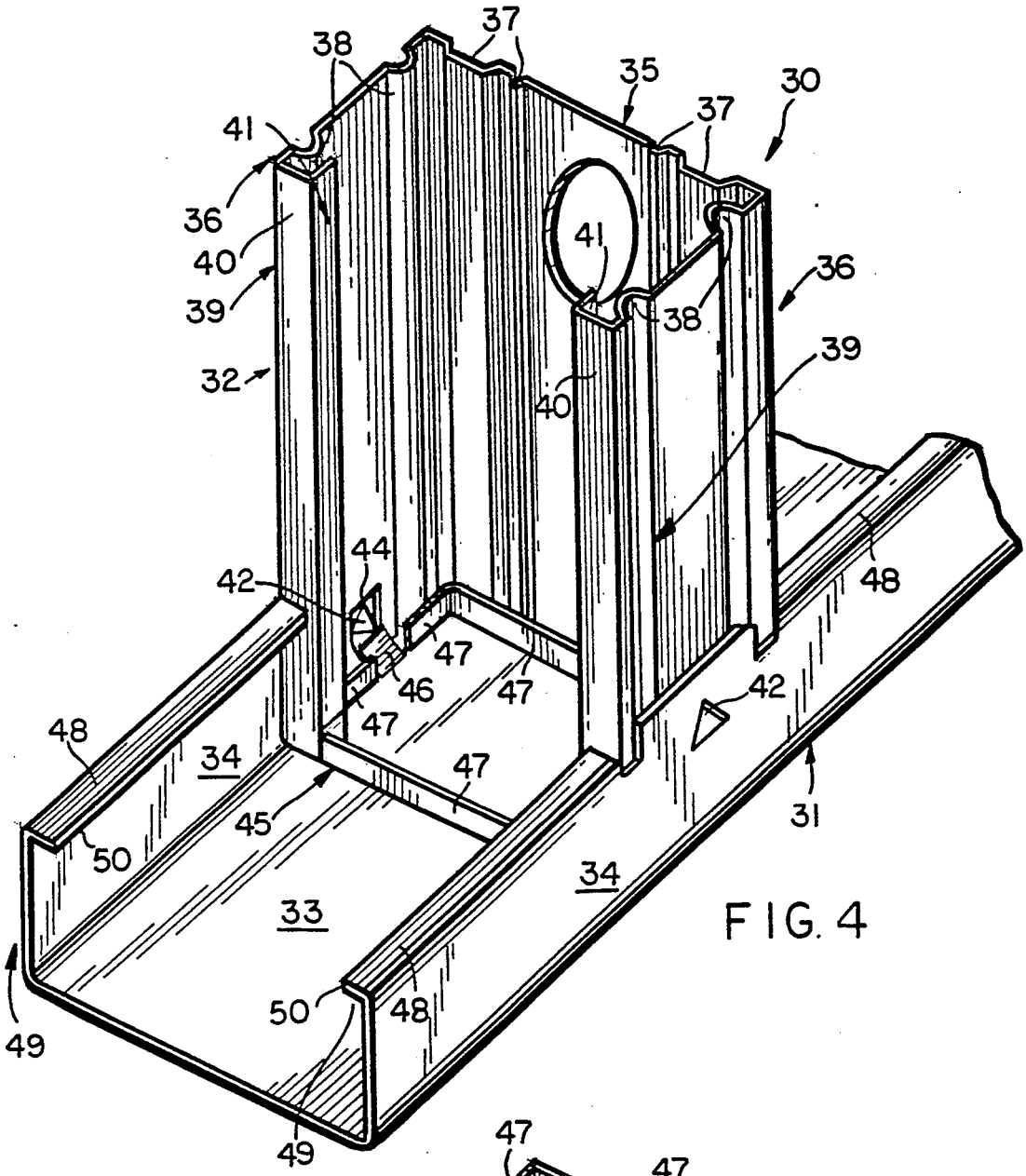
FIG. 4 is a schematic perspective view of a bottom wall plate and a stud attached thereto.
Figure 5:
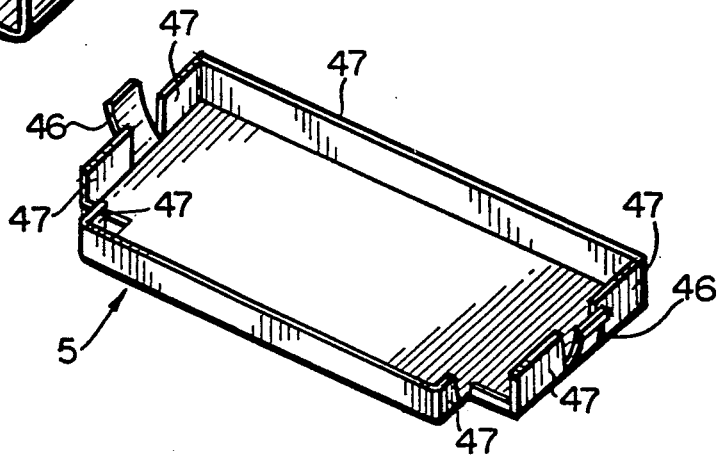
FIG. 5 is a schematic perspective view of a clip employed to aid in securing the stud to the wall plate of FIG. 4.
Figure 6:
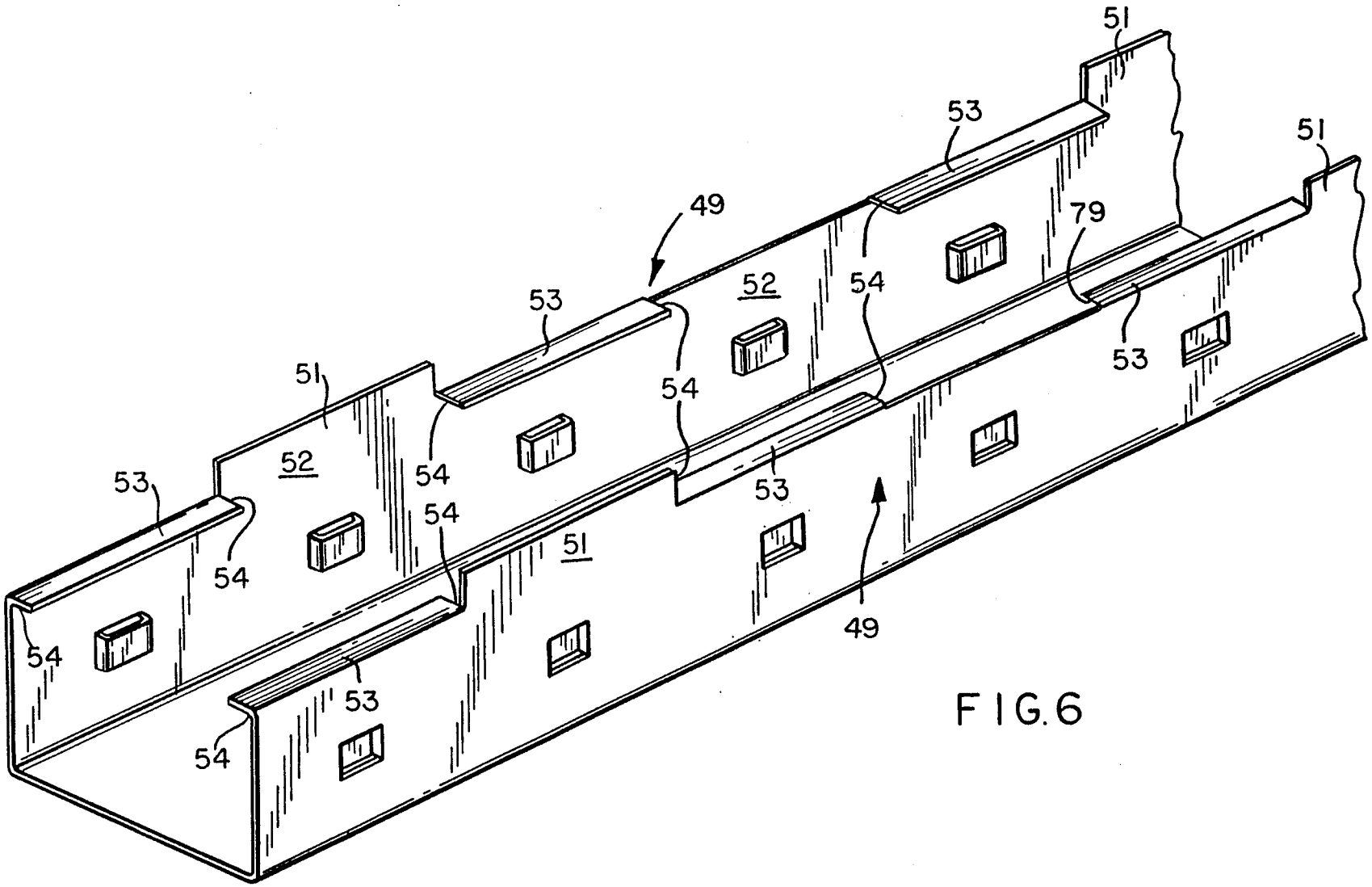
FIG. 6 is a schematic perspective view of a modification of the wall plate of FIG. 4.

In FIGS. 1 to 3 of the accompanying drawings, the wall frame structure of this invention preferably comprises a pair of spaced parallel, horizontal wall plates positioned at the top and bottom of the frame which are bridged by a plurality of spaced, upright wall studs. FIG. 1 shows the construction of each wall plate 4 and each stud 5, both being produced from rolled steel or other metal. The invention is concerned with the formation of the plates 4 and studs 5 and their manner of interconnection, and this is typified by the fragmentary illustration of FIG. 1 of interconnection between the lower end of a single stud and a bottom plate. An identical interconnection is made between the upper end of the stud and the top plate.

The wall plate 4 is "U-shaped" in cross-section, i.e. having a flat base 6 and upright parallel walls or side numbers 7 and 8 provided with inwardly projecting rectangular impressions 9 arranged in a row along each of the walls 7 and 8. The impressions 9 may be formed while the plate 4 is in blank form prior to roll forming. A battery of punches and dies may serve to form the impressions 9 in a single pass of a blank for the wall plate 4. These tools (not shown) operate to press the metal of the wall 7 or 8 into internal impressions 9 with simultaneous shearing along shear lines 10 thus to provide openings at the top 11 and bottom 12 of the formed impressions 9.

Each stud 5 is preferably composed of rolling "C-shaped" steel section with longitudinally extending reinforcing ribs 13 pressed into the side walls 14 and 15 and the base 16. Rectangular apertures 17 are provided near the end of the stud 5 in the side walls 14 and 15 the dimensions of which are no less than, and preferably close to, the outside dimensions of each of the impressions 9. Thus, a selected one of the impressions 9 may be accommodated within an aperture 17 to protrude therethrough beyond the inner face of the wall 14 or 15. Each impression 9 protrudes sufficiently beyond the inner face to reveal its open top and bottom.

A locking clip 18, shown in more detail in FIG. 2, is provided with tongues 19 for insertion through the open top 11, or bottom 12, of the impression 9 adjacent the inner face of the respective wall 14 or 15. The tongues 19 are ganged together by a bridging arm 20 for simultaneous insertion of a pair of tongues 19 through the openings in a confronting pair of impressions 9. A transverse corrugation 21, directed inwardly of the clip 18 is provided near the root end 22 of each of the tongues 19. By the provision of an impression or projection 23 in each of the walls 14 and 15 above the aperture 17 the clip 18 can be snapped, and retained, in position by location of the impression 23 within an adjacent corrugation 21.

An alternative form of locking clip 18A is shown in FIG. 3 which is provided with a tongue 19A and retaining corrugation 21A which at is root end 22A is integrally formed with an operating tab 20A to assist in insertion and withdrawal from an impression 9.

It will be appreciated from an understanding of the above description that a rugged and rigid connection between any wall plate 4 and stud 5 is achieved. Regardless of manufacturing tolerances in the components rigidity is achieved through the use of the locking clip 18. Furthermore, interlocking between any stud 5 and plate 4 is initially effected by insertion of a stud 5 along its axis into the channel of a plate 4 so that the extreme end of the stud 5 engages with the base 6 of the plate 4. To assist in such insertion an inwardly directed inclined lug 24 is formed at the opposite ends of each of the walls 14 and 15 of each stud 5 to form a ramp as a lead-on for the impressions 9. Thus during axial insertion of the stud 5 the walls 7 and 8 of a plate 4 as well as the walls 14 and 15 of a stud 5 will flex to allow entry of the impressions 9 into the apertures 17.

In FIGS. 4 to 8 of the accompanying drawings there is schematically depicted the join 30 of a bottom wall plate 31 with a wall stud 32.

The bottom wall plate 31 is a rolled metal channel member of generally "U-shaped" transverse cross action so as to have a longitudinally extending base 33 and a pair of longitudinally extending side flanges 34. The stud 32 is also a rolled metal channel member providing a longitudinally extending base 35 and a pair of longitudinally extending side flanges 36. The base 35 has longitudinally extending ridges 37 while the side flanges 36 are each provided with longitudinally extending ridges 38. Each of the side flanges 36 terminates at its longitudinally extremity with an "L-shaped" Lip 39. Each Lip 39 has a first longitudinally extending portion 40 extremely parallel to the base 35, and a second longitudinally extending portion 41 extending generally parallel to the side flanges 36.

Each of a wall plate side flanges 34 is provided with a plurality of resiliently deflectable tabs 42 which are pressed from the side flanges 34 so as to be integrally formed therewith and provide downwardly facing abutment surfaces. The tabs 42 are located at space intervals along the side flanges 34.

The lower end of the stud 32 is provided with a pair of apertures 44 located so that associated tabs 42 may project therethrough. A clip 45 having a pair of legs 46 is located so that the legs 46 engage beneath the tabs 42 to thereby secure the stud 32 in position. More particularly, the clip 45 has edge portions 47 which engage the internal surfaces of the stud 32 to prevent separation of the stud 32 from the plate 31.

The longitudinally extending edge portions 49 of the side flanges 34 include longitudinally extending lips 48 which are generally horizontally extending and terminate with horizontally facing edges 50. By having the edges 50 horizontally extending, vertically facing dangerous edges are avoided.

The lips 48 are regularly notched so as to provide notches 52. The notches 52 enable vertically extending portions 51 to extend upwardly adjacent the stud 32. Each of the lips 48 therefore consists of lip segments 53 having end edges 54. The end edges 54 engage the stud 32 to aid in retaining the wall stud 32 in position. This particular configuration is resistent in respect of shear forces.

During installation of the wall stud 32 into the associated plate 11, the stud 32 is moved vertically down between adjacent lip portions 53 until the lower edge of the stud 32 engages opposing pair of tabs 42. As the stud 32 moves downward, the tabs 42 are resiliently deflected so that the lower end of the stud 32 may pass thereby until the tabs 42 are aligned with the apertures 44. Thereafter, the tabs 42 snap engage through the aperture 44 to provide a secure connection. Movement of the tabs 42 may be a combination of resilient deformation of each of the tabs 42 and/or resilient deformation of the side flange 34.

Figure 7:
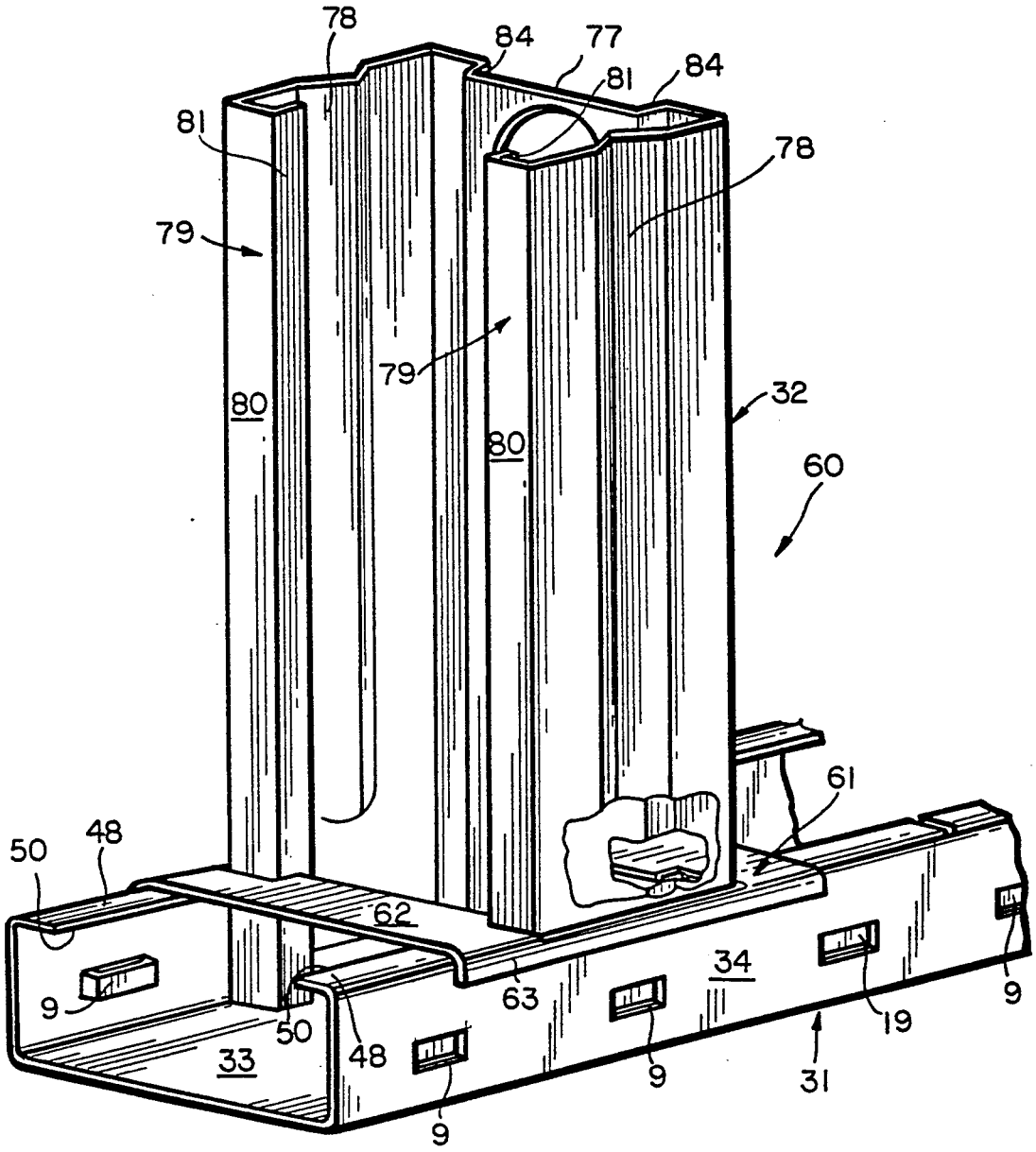
FIG. 7 is a schematic perspective view of a further wall plate and stud.
Figure 8:
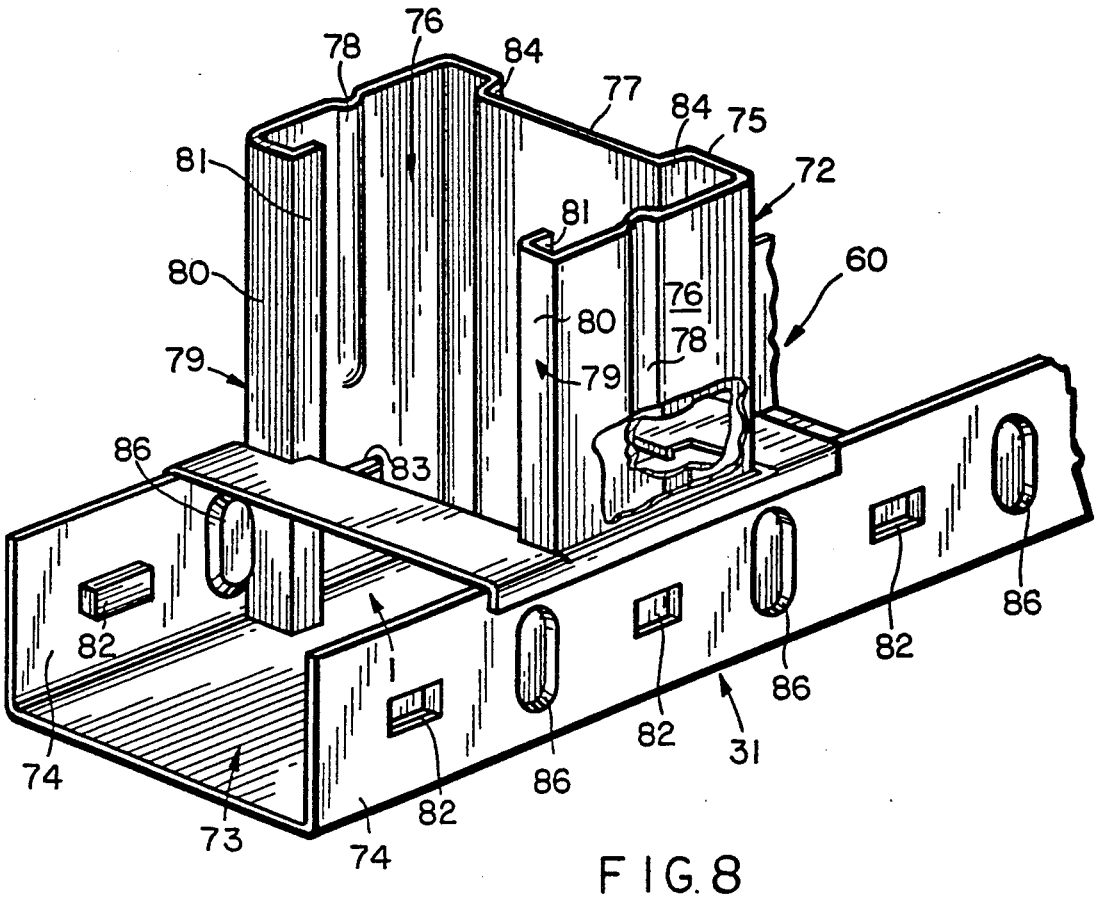
FIG. 8 is a schematic perspective view of a still further wall stud and wall plate.
Figure 9:
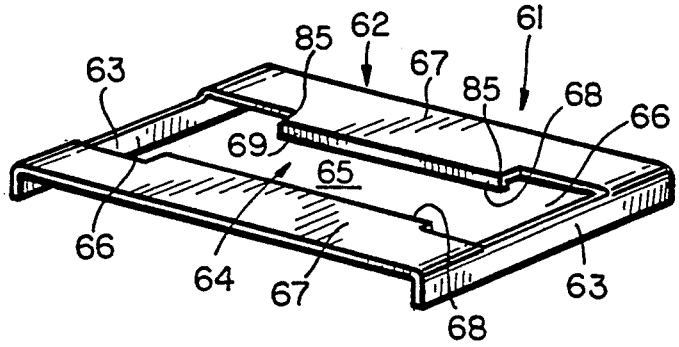
FIG. 9 is a schematic perspective view of a clip bracket used in with the stud and wall plate of FIG. 8.

In FIGS. 7 to 9 there is schematically depicted the joint 60. In the preferred embodiment of FIG. 7, the joint 60 is reinforced by a reinforcing bracket 61. The reinforcing clip bracket 61 is formed from a piece of sheet metal so as to have a central portion 62 and two end flanges 63. The flanges 63 are generally perpendicular to the central portion 62. The central portion 62 is provided with an aperture 64 having a central neck 65 and two end portions 66. The aperture 64 is located between two legs 67 extending between the two end flanges 63. Each of the legs 67 has an "L-shaped" flange 68. Each flange 68 has a lip 69 extending generally normal to the plane of the legs 67.

In use of the above described reinforcing bracket 61, the flanges 63 abut the flanges 34 of the wall plate 31, to inhibit deflecting of the flanges 34 apart when stressed. The wall stud 32 is also reinforced by engagement of the "L-shaped" flanges 67 within the recess 77, and abutment with the portion 80 and 81 of the studs 72. The flanges 67 prevent inward deflection of the lips 19 and reinforce the base portions 15. By engaging the longitudinally extending surfaces 70.

The bracket 61 is a "snug fit" with respect to the wall plate 31 and stud 32 so as to reinforce the joint 60 to enable it to withstand higher stresses, as may be expected during an earthquake or cyclone.

In FIG. 8 the bottom wall plate 31 is a rolled metal channel member of generally "U-shaped" transverse cross section so as to have a longitudinally extending base 73 and a pair of longitudinally side flanges 74. The stud 72 is also a rolled metal channel member. The stud 72 is of a "C-shaped" transverse cross section so as to have a base 75 and a pair of longitudinally extending side flanges 76. The base 75 has a longitudinally extending central recess defining portions 77, while the side flanges 76 are each provided with a longitudinally extending rib 78. Each of the side flanges 76 terminates at its longitudinally extending edge with an "L-shaped" lip 79. Each lip 79 has a first longitudinally extending portion 80 generally parallel to the base 75, and a second longitudinally extending portion 81 extending generally parallel to the side flanges 76.

Each of the wall plate side flanges 74 is provided with a plurality of projections 82 which are equally longitudinally spaced and project transversely towards the opposite flange 74. Each projection 82 is required within a corresponding recess 83 in the lower end of the wall stud 72.

The base 75 is also provided with steps 84 which engage corresponding portion 85 on the bracket 61.

Further deformations 86 may be provided to enhance the bond between the stud 72 and plate 31.

Whereas a preferred embodiment has been described in the foregoing passages it should be understood that other forms, modifications and refinements are feasible within the scope of this invention.

The claims defining the invention are as follows:

1. A wall frame structure including:

a generally horizontally extending metal plate of generally "U-shaped" transverse cross-section so as to have longitudinally extending substantially parallel transversely spaced side walls, said side walls being joined by a longitudinally extending base, each side wall being deformed to have a plurality of deformations which project inwardly toward the other side wall, and which deformations are arranged in pairs, with each pair including a deformation from each side wall;

a substantially vertically extending metal stud of substantially "C-shaped" transverse cross-section so as to have longitudinally extending transversely spaced parallel side walls joined by a longitudinally extending base, said stud having adjacent one end an aperture in each stud side wall and engaged with said plate by being positioned between the plate side walls and by having the plate side walls abutting the stud side walls so as to be substantially superposed with respect thereto, each stud side wall having an aperture aligned with a respective deformation of a pair of deformations of said plate so that the associated pair of deformations extends through the apertures; and clip means engaging the deformations associated with said stud and abutting the stud side walls to thereby inhibit separation of each stud side wall with its associated superposed plate side wall, under loading.

2. The wall frame structure of claim 1, wherein each plate side wall is provided with further deformations, which further deformations project inwardly so as to extend toward the other plate side wall, said further deformations being arranged in pairs and being spaced longitudinally on the plate so that each stud is located between two pairs of further deformations.

3. The wall frame structure of claim 1, wherein said deformations provide downwardly facing abutment surfaces, and said clip means is a clip comprising a base having longitudinal ends which extend between said stud side walls, and a leg portion adjacent each longitudinal end of the clip base, each said leg portion abutting the abutment surfaces of the associated deformations.

4. The wall frame structure of claim 3, wherein longitudinally extending extremities of each stud side wall are provided with a flange extending generally parallel to the stud base, and said clip has edge portions engaged with the stud side walls and flanges to aid in inhibiting separation of the plate side walls with respect to the stud side walls.

5. The wall frame structure of claim 3, wherein said legs are resilient deformable to allow insertion of the clip by passing said legs over the associated deformations to cause resilient deflection of the legs so that said clip can be located at a position abutting said plate base with said legs extending upwardly from said clip base.

* * * * *